United States Patent [19]

Pauli

[11] 4,275,706

[45] Jun. 30, 1981

[54] AIR-COOLED GRATE BAR

[75] Inventor: Balduin L. Pauli, Gauting, Fed. Rep. of Germany

[73] Assignee: Wärmetechnik Dr. Pauli GmbH & Co. Betriebs KG, Gauting, Fed. Rep. of Germany

[21] Appl. No.: 50,488

[22] Filed: Jun. 20, 1979

[30] Foreign Application Priority Data

Jul. 28, 1978 [DE] Fed. Rep. of Germany ..... 2833255

[51] Int. Cl.[3] ..... F23H 1/02

[52] U.S. Cl. ..... 126/163 R; 126/163 A; 126/168; 110/268

[58] Field of Search ..... 126/163 R, 163 A, 167, 126/180, 152 R, 168; 110/268, 269, 270, 273, 274

[56] References Cited

U.S. PATENT DOCUMENTS

| | | | |
|---|---|---|---|
| 1,330,536 | 2/1920 | Hopwood | 110/268 |
| 1,513,987 | 11/1924 | Hare | 110/268 |
| 1,522,919 | 1/1925 | Skelly | 110/268 |
| 1,715,294 | 5/1929 | Hulson | 126/163 R |
| 4,018,168 | 4/1977 | Andreoli et al. | 110/268 |

*Primary Examiner*—James C. Yeung

*Attorney, Agent, or Firm*—Balogh, Osann, Kramer, Dvorak, Genova & Traub

[57] ABSTRACT

The present invention relates to air-cooled grate bars, in particular for mechanically conveying mechanical grates such as pivot step grates, comprising a cap of U-shape which is provided over the respective grate bar and is in particular welded on and which forms with the grate bar disposed therebelow passages extending longitudinally of the grate bar, the cap being led at the bearing-side end of the grate bar up to shortly before the curvature end and the cap and thus the passages being in each case sealed at the end face at the curved cap end.

12 Claims, 5 Drawing Figures

AIR-COOLED GRATE BAR

The present invention relates to air cooled grate bars, in particular for mechanically conveying grates such as pivot step grates.

Under extreme combustion conditions, in particular with large and wide grate bar members, in particular wide grate bar members, the air passing from the air funnel at the sides of the grate bars, i.e. sweeping over and between the grate bars, is not adequate to cool the grate bars sufficiently. If bulky materials are burnt on the grate bars, such as wooden cable drums, generally the fuel layer protecting the grate bar suface is lacking and extreme combustion conditions obtain. This means that the temperatures at the grate bar surface exceed the permissible temperatures of 900° to 1000° C. The grate bar surface softens. Corrosive substances such as chloride, sulfur, etc., penetrate; the grate bar forms scales and corrodes.

Known grate bar cooling systems (DRP 48,347) in which the parts are assembled with rivets are suitable only for relatively low combustion temperatures. Also, the grate bars are not cooled in the region of the air gap separating them.

The objective of the present invention is to control the grate bar cooling positively and in particular to cool also the region between the grate bars, that is in particular the side flanks of the grate bars.

This double function is achieved surprisingly simply according to the invention by a cap of U-shape which is provided over the respective grate bar and in particular welded on and which forms with the grate bar disposed therebelow passages extending longitudinally of the grate bar. The combustion air is conducted and preheated by said passages. The grate bar is not only cooled; the combustion air is also heated; the features described hereinafter also effect a cooling of the flanks.

Preferably, the cap is led from the bearing-side end of the grate bar up to a point shortly before the edge of the curvature end of the grate bar, and thus the passages are in each case sealed at the end face at the curved cap end.

Advantageously, the air exits of the grate bars both in the flat region and in the steep region open into the air funnels disposed beneath each step. This is utilized to supply the preheated combustion air from the air funnels via air gaps between the grate bars. Generally, the entire combustion air is led in constrained manner in the grate bars and the entire combustion air emerges between the grate bars from the air funnel into the combustion chamber. Thus, no heat is lost.

Expediently, the combustion air is led from an air box common to the grate bars of a grate via an air distributor having one discharge pipe per grate bar via a connected metal hose to the air inlet pipes of the respective grate bar.

It is particularly expedient for the cap to consist of DIN X 15 CrNiSi 2012 steel but it may also be made from special steel casting Cr 28 Ni 5 (material 4823). The now protected grate bar however may also consist of cheaper materials. After the welding of the grate cap the side faces are ground smooth so that outwardly the grate bar again has the form of a box possibly half open downwardly. The cap serving for wear protection has the form of a U-shaped section with downwardly pointing legs in cross-section with a continuously interrupted transverse web supported upon the grate surface. This contributes to avoiding distortions. A so-called torsion box results and this is particularly favourable as regards the strength.

Thus, immediately beneath the cap continuous passages are formed which communicate because of the interruptions in the transverse bars.

The height of the passages is about 8 mm to 14 mm. The (upwardly pointing) web of the U-shaped section, i.e. the thickness of the wear-protection cap, is about 6 mm to 8 mm. This gives a sort of directed film cooling for the grate bar surface.

Possibly, to avoid expansion in particularly highly stressed regions, on the grate bar surface intentional fracture points, for example in V-form (V-grooves), may be provided to relieve stress.

To prevent the welded cap from lifting off and distortion of the surface, highly heat-resistant pins are welded onto the grate bar to form the webs and in the region of the pins the wear lining is provided with holes whose extent is greater than the diameter of the pins or bolts, burnt or cut in, and the cap is then fitted, the pins projecting upwardly into the holes. The hole is then welded to the bolt and the surfaces again ground smooth.

The air may be applied so that the air flow divides in the opposite direction and flows through the grate bar, said air then emerging into the air funnel disposed therebelow.

The air supply may however also be such that the air inlet is at the one side of the air passages formed and the exit at the other side. In moving grates, for which the subject of the invention is particularly intended, the air supply is provided as close to the joint as possible so that the travel of the air supply member (metal hose) is not too large.

When worn, the cap is separated from the grate bar for example by cutting, the grate bar reprepared and a new cap welded on.

Since the cost of the grate bar is several times that of the wear cap, this results in a considerable reduction in costs.

The features of the invention are particularly suitable for large and wide grate bars of stationary or mechanically conveying (moving) grates. In particular, step grates, preferably pivot step grates, are possible.

During the air cooling the air heats up to 40° to 50° C. and possibly more. It is blown into the sealed air funnel and from the latter passes between the grate bars as preheated combustion air and thus considerably promotes the combustion process. On passage through the air passages of the grate bar a cooling of the grate bar surface takes place of up to 300° , which can lead to several 100° C. at the individual surfaces. Due to this considerable cooling, either the material of the cap may be made less resistant to heat and thus less expensive or a higher temperature may be allowed in the combustion chamber for the uncovered grate.

In step grates the side wall bars (between moveable steep grate and moveable flat grate), having a substantially triangular form, may be covered at the top and laterally with such a cap.

If such a grate bar is considered in side view, on the side at which it is articulately mounted it is curved about itself to form the bearing. The cap follows the contour of the grate bar from its bearing end downwardly to its curvature end up to a point at which no heat action is to be expected and is then sealed at the end face. In the region of the outer curvature the air enters substantially radially through holes into the interior of the air funnel.

For a pivot step grate favourable values have been found with an air throughput of 50–100 $Nm^3/h$ and an air speed of 20–40 m/sec in the grate bar with a pressure loss of 30–150 mm water head. The fan is designed for 400–500 mm water head because further losses also have to be overcome.

The side wall bars, which close the side wall with respect to a grate bar consisting of flat section and steep section and are stationary, may be also provided with such a cap, adaptations being made because of the form.

Although the air supply into the grate bar takes place substantially adjacent the articulate mounting, after entering the grate bar the air is distributed as uniformly as possible on both sides. For this purpose, means may be provided by which the air is supplied via the nozzles formed. However, the side flanks are cooled by the heated air passing from the air funnel between side wall and adjacent grate bar.

According to another embodiment the air may however be blown in not perpendicularly to the grate bar but substantially in the region of the articulate mounting parallel to said bar. In this case, the entire air then passes through the grate bar in one direction and emerges into the air funnel at the free end, i.e. the straight end in the case of the flat section and the end resting on the lower grate bar in the case of the steep section.

Examples of embodiment of the invention will be explained hereinafter with reference to the attached drawings, wherein.

Figure 1:
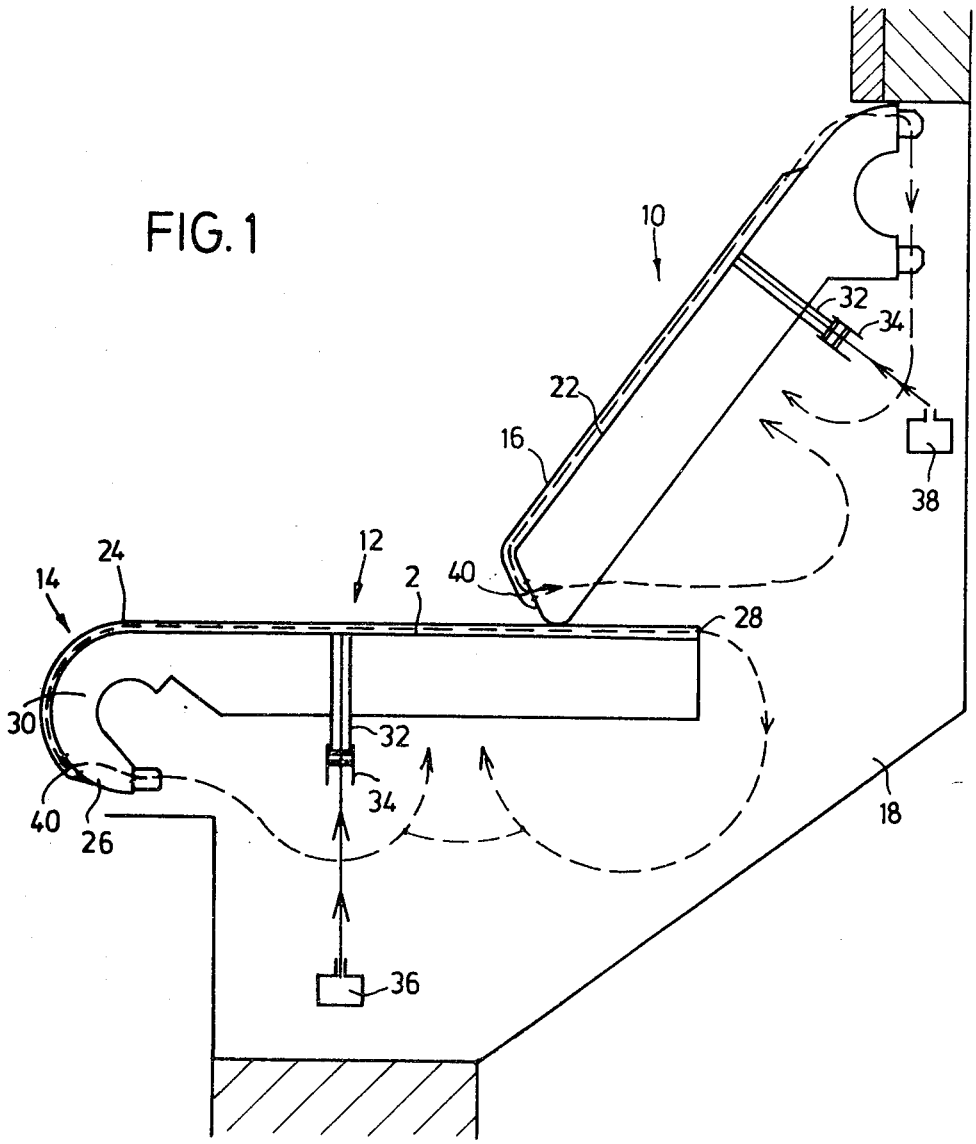
FIG. 1 is a diagrammatic illustration of a grate step.

The pivot grate member according to FIG. 1 consists in a manner known per se of an arrangement of a steep grate (steep section) 10 and a flat grate (flat section) 12 disposed therebelow, the steep grate 10 being supported with its lower end 11 on the flat grate 12 pivotally mounted with its outer end 14 and when the flat grate 12 moves upwardly the steep grate 10 is entrained in the manner described in German Pat. No. 1,299,093. Each pivot grate member is separated from the next member by a gas-tight air-distributing funnel 18; independently from the others, each step grate is movable, adjustable and supplied with air at various pressures.

The air inlet pipe 32 opens in the vicinity of the pivot mounting 14 for the flat section and communicates via a metal hose 34 with the diagrammatically illustrated air-distributing box 36. The air distributing box may however also be provided outside the air funnel 18, as illustrated for example for the steep section 38. The important point is that the air inlet 32 is near the upper bearing (in the steep section) to limit the pivot travel of the hose as far as possible.

FIG. 1 shows only diagrammatically how a cap 24 is provided on the grate bars substantially over the entire bar and is welded on at least in the region of high thermal stress, the end 26 of the cap of the grate bar of the flat section being open, the caps being closed at the end 26 (pivot mounting, flat section) or in the region of the reference numeral 40 for the steep section and in the pivot mounting for the steep section. Air-exit slots are provided only in the region of the end of the cap, designated 40 in the region of the pivot bearing for the grate bar 20 of the flat section, and provided in the region of the pivot bearing of the grate bar 22 of the steep section 10.

By means of a fan which is not illustrated air is supplied via the air-distribution box into the air-inlet pipe 32 and distributes itself on both sides. Air then enters via the air-exit slots into the sealed air funnel 18 in each case. From the latter, because of the excess pressures the air is forced between the grate bars into the combustion chamber and in the latter provides the sole air supply in the form of preheated air. The same is indicated for the steep section. The grate bars 20; 22 have in this manner the function of an air preheater.

Figure 2:
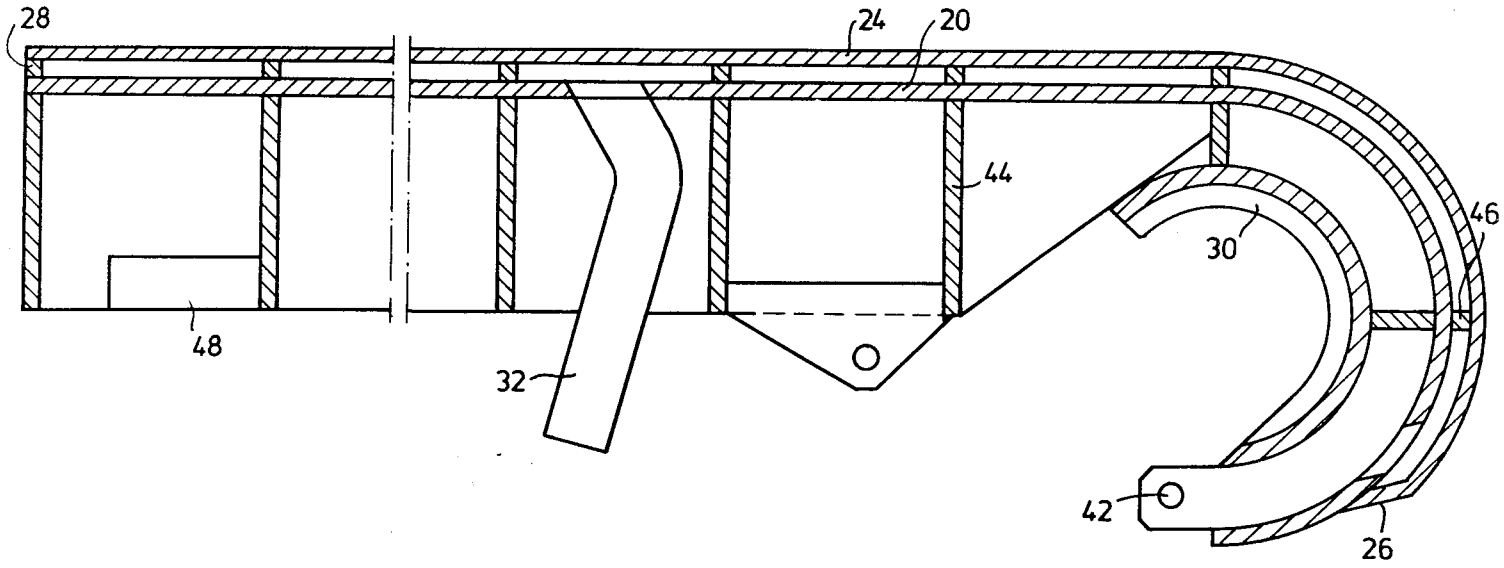
FIG. 2 is a section through a grate bar.
Figure 3:
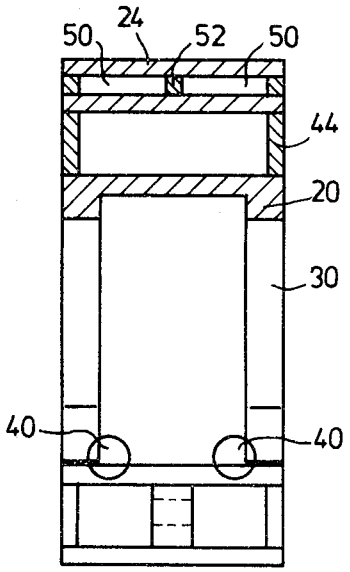
FIG. 3 is a section along the line A—A of FIG. 2.

In FIGS. 2 and 3 a flat grate bar 20 for a pivot step grate, is shown in more detail. Identical reference numerals designate the same parts. It can be clearly seen here how the cap 24 is welded over the normal grate bar 20, the mounting, in particular the bushing 30, the support ribs 44, the mounting 42 for the support plates and the bearing of which are illustrated in detail. To prevent the cap distorting or warping or lifting off with respect to the grate bar spacer pins or bolts are welded onto the grate bar and may have in particular the form 50×10 mm. By cutting, corresponding cutouts are formed in the cap, the cap fitted and the pins projecting into the cap snugly welded. Thereafter, the weld points are ground smooth. The welds are no longer visible in the finished grate bar. In the region 28, the end of the caps, there are the air-exit slots of the air passages for this bar, as more clearly apparent in FIG. 3. 48 indicates the return means for the grate, which are not designated in detail. It is clearly apparent that the cap in FIG. 2 is drawn downwardly so that its closed end 26 is at a point where no heat action is to be expected. The air which has passed through the grate bar enters via the openings 40 into the interior of the grate bar mounting and from there into the air funnel, i.e. additionally cools the bearing. The direction of the air opening 40 is downwardly inclined by 15° with respect to the horizontal.

The air-inlet pipe 32 enters the grate bar at a direction of 45° to the vertical. It is however possible to introduce the air-inlet pipe perpendicularly to the grate bar and to provide means for producing two nozzle flows of opposite direction.

Figure 4:
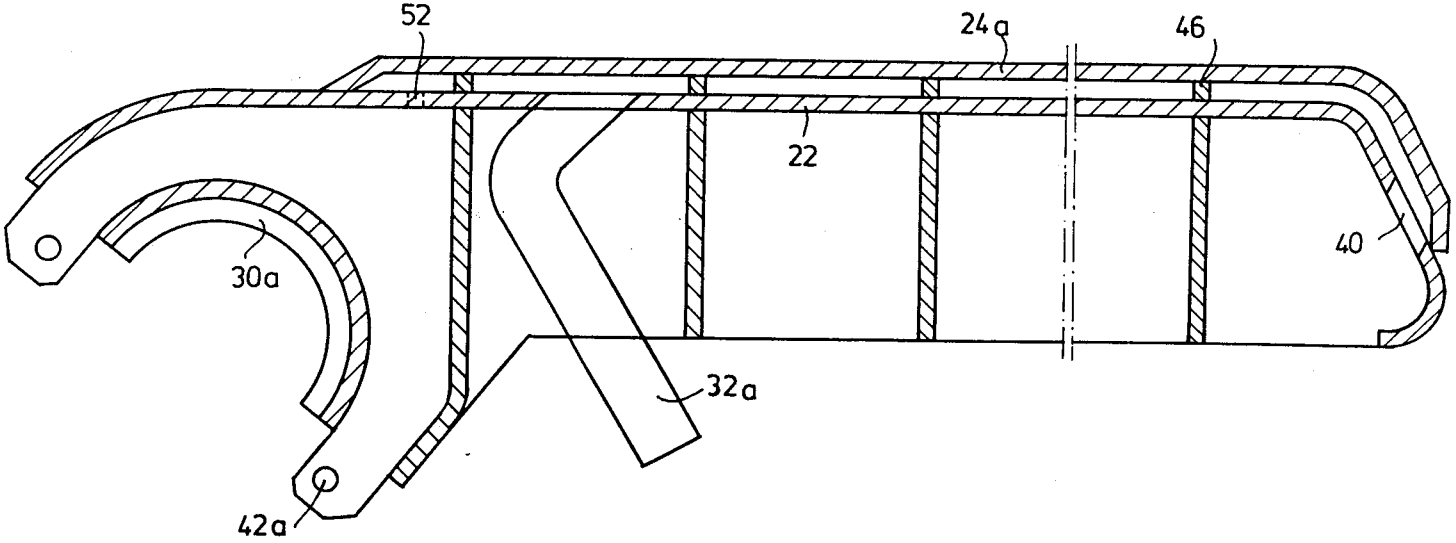
FIG. 4 is an illustration similar to FIG. 3.

It is clearly apparent from FIG. 3 how by fitting and welding the cap 24 a torsion box is formed with the grate bar which, the interrupted centre web 52 contributing to this effect, is particularly resistant to twisting. The section A—A in FIG. 2 is through the bearing structure of the pivot grate bar and consequently a torsion box also results for the grate bar. It is apparent that due to the grinding after the welding the observer only sees the grate bar as a whole. In the region of the centre webs, when worn the cap can however be separated and a new cap welded on. FIG. 4 shows a steep grate bar 22. In this case, parts corresponding to the previous figure have the same reference numerals with the addition of "a". The grate bar is pivotal about its mounting, in particular with the bushing 30*a*; the mounting for the support plate is designated by 42*a*. Since the pivot mounting is substantially under masonry, the cap 24*a* terminates before the vertical projection of the bearing centre. According to the example the cap is closed inclined with respect to the grate bar. 52*a* denotes a vertical bore in the region of the mounting and 40*a* a bore of the free bar end lying at 60° to the horizontal. The cap terminates tangentially to the rounded portion of the front grate bar end. The support webs 46*a* again form communicating air passages in the interior of the cap. The air-inlet pipe 32*a* is led into the grate bar at an angle of 45° to the vertical. The air-inlet pipe itself has a curvature of 105°. Since the air-exit slots 52 and 40*a* are projected from the fuel layer, these slots remain free from clogging even under extreme combustion conditions and the entire preheated air from the air funnel is available for cooling the flanks of the grate bars.

Figure 5:
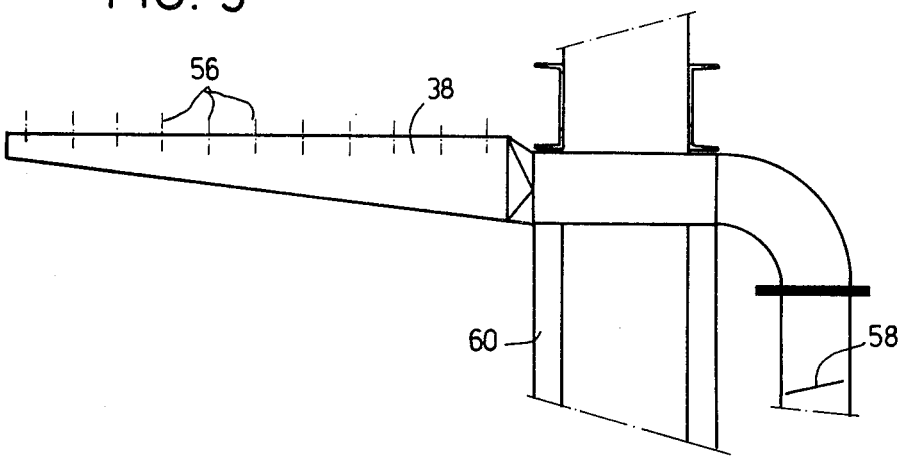
FIG. 5 is an air distributing box or manifold.

FIG. 5 finally illustrates the air-distributing box 38 illustrated only diagrammatically in FIG. 1. This box is quadratic and rectangular in plan view and in side elevation tapers in the form of a truncated cone having eleven air-exit pipes 56 in the example of embodiment illustrated. From the air-exit pipes 56 for example 11 flexible metal hoses 34 extend to the air-inlet pipes 32 of the grate bars. Thus, each grate bar has its own air-exit pipe 56 on the air-distributing box and its own air-inlet pipe. It is possible by means of a control device, for example a flap, to supply air to each grate bar separately. It is thus possible to achieve a directed independent cooling of the grate bar and thus for example to cool the grate bars in the centre more than those disposed at the edges. Each pivot grate member has its own air-distributing box 38 and 36 for the steep section and flat section respectively. The total air supplied to the air-distributing box is controllable by a control means for example a flap 58, and may thus be shut off when starting up the pivot step grate. 60 indicates a support structure for the air-distributing box which is not explained in detail. The air-distributing box may be provided both outside and inside the air funnel.

Summarizing, it is pointed out that air can be supplied in controlled manner to any grate bar by means of an air conducting system, the conducting system being formed by the wear caps as air passage. The total air is led via the grate bars into the air funnel and emerges as preheated air therefrom along the flanks of the grate bars into the combustion chamber. Any clogging of the air-exit slots is avoided because the air is not discharged directly into the combustion chamber. The air gaps remain free, an effect which is promoted in the step pivot grate by the movement of the grate bars. Since no air discharge takes place directly at the cap, the slots cannot clog. Because of the cooled cap the grate bar may be made from a material of low quality. This leads to long service lives and low repair occurrence. Repairs are made simple by exchanging the wear cap and this also increases the life of the grate bar. The grate bar may even remain uncovered during operation. It withstands high combustion chamber temperatures arising surprisingly due to radiation. Thus, even bulky objects, for example cable drums which do not cover the grate surface, may be burnt. Due to the cooling the material has a greater resistance; the resistance to corrosion increases. Due to the higher combustion chamber temperatures the burning is more complete and improved efficiency is achieved. The air supply is very accurate because each grate bar is supplied separately and air-adjusting flaps may be incorporated.

What we claim is:

1. An air-cooled grate bar, in particular for mechanically conveying mechanical grates such as pivot step grates, comprising a cap which is provided over the respective grate bar so as to protect the same from wear due to excessive heat, and air passages formed by said cap with the respective grate bar, said passages extending longitudinally of the respective grate bar, said cap having a U-shaped section with downwardly pointing legs in cross-section and a continuously interrupted transverse web supported upon the respective grate bar.

2. A grate bar as set forth in claim 1, wherein the cap is provided substantially over the entire surface of the respective grate bar, and is welded thereon at least in a predetermined region of high thermal stress.

3. A grate bar as set forth in claim 1, further comprising a gas-tight air funnel for separating one grate bar from another.

4. A grate bar as set forth in claim 1, wherein the grate bar has a bearing end and a curvature end, and said cap overlapping the grate bar follows the contour thereof from said bearing end downwardly up to a predetermined point on the curvature end at which no heat action is to be expected, the end of said cap at the curvature end being sealed so as to seal said air passages at this point.

5. A grate bar as set forth in claim 1, in which said web forms communicating air passages in the interior of said cap.

6. A grate bar as set forth in claim 3, wherein the grate bar has a flat region and a steep region, and is provided with air exits both in the flat region and in the steep region, that open into said gas-tight air funnel.

7. A grate bar as set forth in claim 6, wherein preheated combustion air can be supplied from said gas-tight air funnel via air gaps between grate bars.

8. A grate bar as set forth in claim 7, wherein the entire combustion air is led in constrained manner over the grate bar.

9. A grate bar as set forth in claim 7, wherein the combustion air is led from an air box common to all grate bars of a grate, via an air distributor having one discharge pipe per grate bar via a connected metal hose to air inlet pipes of the respective grate bar.

10. A grate bar as set forth in claim 6, wherein the openings of said air exits remain always unclogged and free to the flow of air into said air funnel.

11. A grate bar as set forth in claim 1, wherein said cap consists of heat-resistant steel, especially X 15 CrNiSi 2012.

12. A grate bar as set forth in claim 1, wherein said cap consists of heat-resistant special steel casting Cr 28 Ni 5.

* * * * *